US008636152B1

(12) United States Patent
Weigand

(10) Patent No.: US 8,636,152 B1
(45) Date of Patent: Jan. 28, 2014

(54) GREETING CARD OUTPOST

(75) Inventor: Christopher Weigand, Peninsula, OH (US)

(73) Assignee: American Greetings Corporation, Cleveland, OH (US)

( * ) Notice: Subject to any disclaimer, the term of this patent is extended or adjusted under 35 U.S.C. 154(b) by 59 days.

(21) Appl. No.: 13/549,621

(22) Filed: Jul. 16, 2012

(51) Int. Cl.

| | |
|---|---|
| ***A47F 7/14*** | (2006.01) |
| ***A47F 5/08*** | (2006.01) |
| ***A47F 5/14*** | (2006.01) |
| ***A47G 29/00*** | (2006.01) |
| ***A47F 5/13*** | (2006.01) |
| ***A47B 63/00*** | (2006.01) |
| ***A47B 55/02*** | (2006.01) |
| ***A47B 57/00*** | (2006.01) |

(52) U.S. Cl.

CPC ..... *A47F 7/148* (2013.01); *A47F 5/132* (2013.01); *A47F 7/147* (2013.01); *A47B 63/00* (2013.01); *A47B 55/02* (2013.01); *A47B 57/00* (2013.01)

USPC ..... 211/55; 211/85.31; 211/150; 211/181.1

(58) Field of Classification Search

CPC ..... A47F 5/006; A47F 5/0018; A47F 5/0031; A47F 5/01; A47F 5/02; A47F 5/16; A47F 5/132; A47F 5/105; A47F 5/08; A47F 5/13; A47F 5/0025; A47F 5/10; A47F 5/0869; A47F 5/0823; A47F 7/148; A47F 7/145; A47F 7/146; A47F 7/147; A47F 7/163; A47F 7/283; A47F 13/085; A47B 63/00; A47B 49/00; A47B 63/062; A47B 63/06; A47B 55/02; A47B 57/00; A47B 96/028; A47B 57/04; B42F 17/02; B42F 17/04; B25H 3/04

USPC ..... 211/52, 55, 50, 53, 56, 58, 106, 44, 45, 211/181.1, 85.31, 85.26, 163, 70, 204, 206, 211/175, 144, 150, 168; 40/642.01, 642.02, 40/654.01, 660; D6/464, 462, 465, 455, D6/457, 409–415, 332, 449, 477–479, 396, D6/397, 474; 312/50, 117, 128; 248/346.03, 153

See application file for complete search history.

(56) References Cited

U.S. PATENT DOCUMENTS

| | | | | | |
|---|---|---|---|---|---|
| 838,294 | A | * | 12/1906 | Zeiner | 211/58 |
| 955,589 | A | * | 4/1910 | Fassio | 211/56 |
| 1,235,225 | A | * | 7/1917 | Miller | 211/58 |
| 1,422,659 | A | * | 7/1922 | Bulman | 211/52 |
| 1,432,286 | A | * | 10/1922 | Goldberg | 211/58 |
| 1,432,287 | A | * | 10/1922 | Goldberg | 211/58 |
| 1,713,185 | A | * | 5/1929 | Laughon | 211/55 |
| 1,725,422 | A | * | 8/1929 | Roushar et al. | 211/55 |
| 1,731,875 | A | * | 10/1929 | Snyder | 211/52 |
| 1,870,722 | A | * | 8/1932 | Fratesi, Jr. | 211/53 |

(Continued)

*Primary Examiner* — Jennifer E Novosad

(74) *Attorney, Agent, or Firm* — Christine Flanagan

(57) ABSTRACT

The greeting card outpost of the present disclosure and related inventions is a unique and versatile structure which maximizes the number of greeting cards which can be displayed for sale in retail areas which are limited in space. The fixture includes a plurality of adjacent vertically arranged card pockets attached to an angled support structure and standard tube frame which creates angled array of greeting cards extending outward from a front of the display and ending in a fin-like fashion at the back of the display. The novel arrangement decreases the size of space required to display the variety of greeting cards which can be accommodated upon the outpost fixture.

17 Claims, 4 Drawing Sheets

(56) References Cited

U.S. PATENT DOCUMENTS

| | | | | | |
|---|---|---|---|---|---|
| 1,963,544 | A | * | 6/1934 | Burt | 211/53 |
| D161,451 | S | * | 1/1951 | Humphries | D6/463 |
| 2,609,937 | A | * | 9/1952 | Rubenstein | 211/106 |
| 3,223,247 | A | * | 12/1965 | Bleed | 211/163 |
| 3,313,513 | A | * | 4/1967 | Howell | 248/441.1 |
| 3,844,230 | A | * | 10/1974 | Hudson et al. | 108/60 |
| 4,548,324 | A | * | 10/1985 | Mackey, Jr. | 211/58 |
| 4,723,819 | A | * | 2/1988 | Ramberg | 312/130 |
| 4,744,473 | A | * | 5/1988 | Hardy | 211/55 |
| 5,029,715 | A | * | 7/1991 | Strada | 211/55 |
| 5,226,548 | A | * | 7/1993 | Koeppel | 211/144 |
| 5,253,767 | A | * | 10/1993 | Koeppel | 211/40 |
| 5,259,515 | A | * | 11/1993 | Koeppel | 211/40 |
| 5,462,178 | A | * | 10/1995 | Wallach et al. | 211/95 |
| 5,620,103 | A | * | 4/1997 | Vlah et al. | 211/55 |
| 5,772,055 | A | * | 6/1998 | Orr et al. | 211/186 |
| 5,836,459 | A | * | 11/1998 | Nezwek et al. | 211/50 |
| 5,971,169 | A | * | 10/1999 | Orr et al. | 211/95 |
| 6,308,842 | B1 | * | 10/2001 | Robbins et al. | 211/113 |
| 6,431,375 | B2 | * | 8/2002 | Spencer | 211/106 |
| D584,078 | S | * | 1/2009 | Weigand | D6/473 |
| 7,900,784 | B1 | * | 3/2011 | Weigand et al. | 211/186 |
| D679,922 | S | * | 4/2013 | Weigand | D6/675.2 |
| 2005/0224431 | A1 | * | 10/2005 | Campello et al. | 211/52 |
| 2006/0186063 | A1 | * | 8/2006 | Campbell | 211/55 |

* cited by examiner

GREETING CARD OUTPOST

RELATED APPLICATIONS

There are no applications related to this application.

FIELD OF THE INVENTION

The present invention is in the field of retail fixtures, and more specifically to retail fixtures for the display of greeting cards and/or social expression products.

BACKGROUND OF THE INVENTION

Retail outpost display structures are merchandising displays that are placed in various remote locations within a retail store that contain merchandise that is not typically sold in the area of the display. Maximizing the amount of greeting cards which can be stored and displayed in such areas is difficult given that the retail space typically allotted for such displays is oftentimes limited. Space requirements and aisle configurations often differ considerably not only from store to store but from department to department, making the design and manufacture of flexible outpost structures difficult and expensive.

SUMMARY OF THE INVENTION

The greeting card outpost of the present disclosure and related inventions is a unique and versatile structure which maximizes the number of greeting cards which can be displayed for sale in retail areas which are limited in space. The fixture includes a plurality of adjacent vertically arranged card pockets attached to an angled support structure and standard tube frame which creates angled array of greeting cards extending outward from a front of the display and ending in a v-shaped fashion at the back of the display. The novel arrangement decreases the size of space required to display the variety of greeting cards which can be accommodated upon the outpost fixture.

DETAILED DESCRIPTION OF PREFERRED AND ALTERNATE EMBODIMENTS

Figure 1:
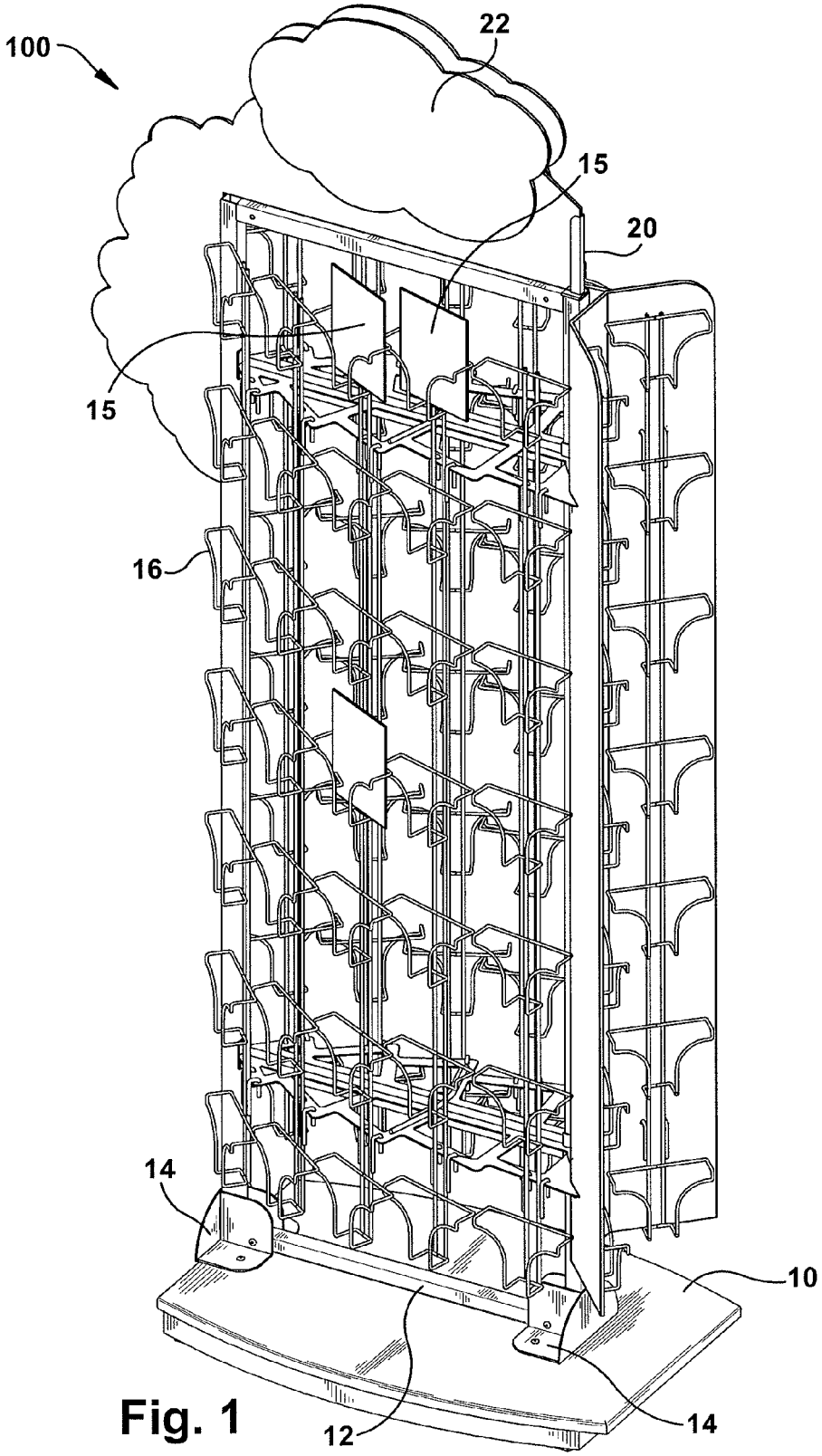
FIG. 1 is a perspective view of the Greeting Card Outpost of the present invention, with signage.

The greeting card outpost fixture 100 (hereinafter referred to as "outpost fixture"; "outpost"; "fixture"; "display fixture"; and "display") of the present disclosure and related inventions provides a novel way to store and display greeting cards in a retail environment. The fixture 100 allows a large number of greeting cards to be displayed in a condensed retail space due to the angled arrangement of greeting card pockets 16 along opposing sides of a display frame 12. The components of the fixture include, but are not limited to: a base 10, a frame 12, one or more pocket supports 18, a plurality of pocket assemblies 17, and various attachment mechanisms such as brackets, and joint connector nuts and bolts.

Figure 4:
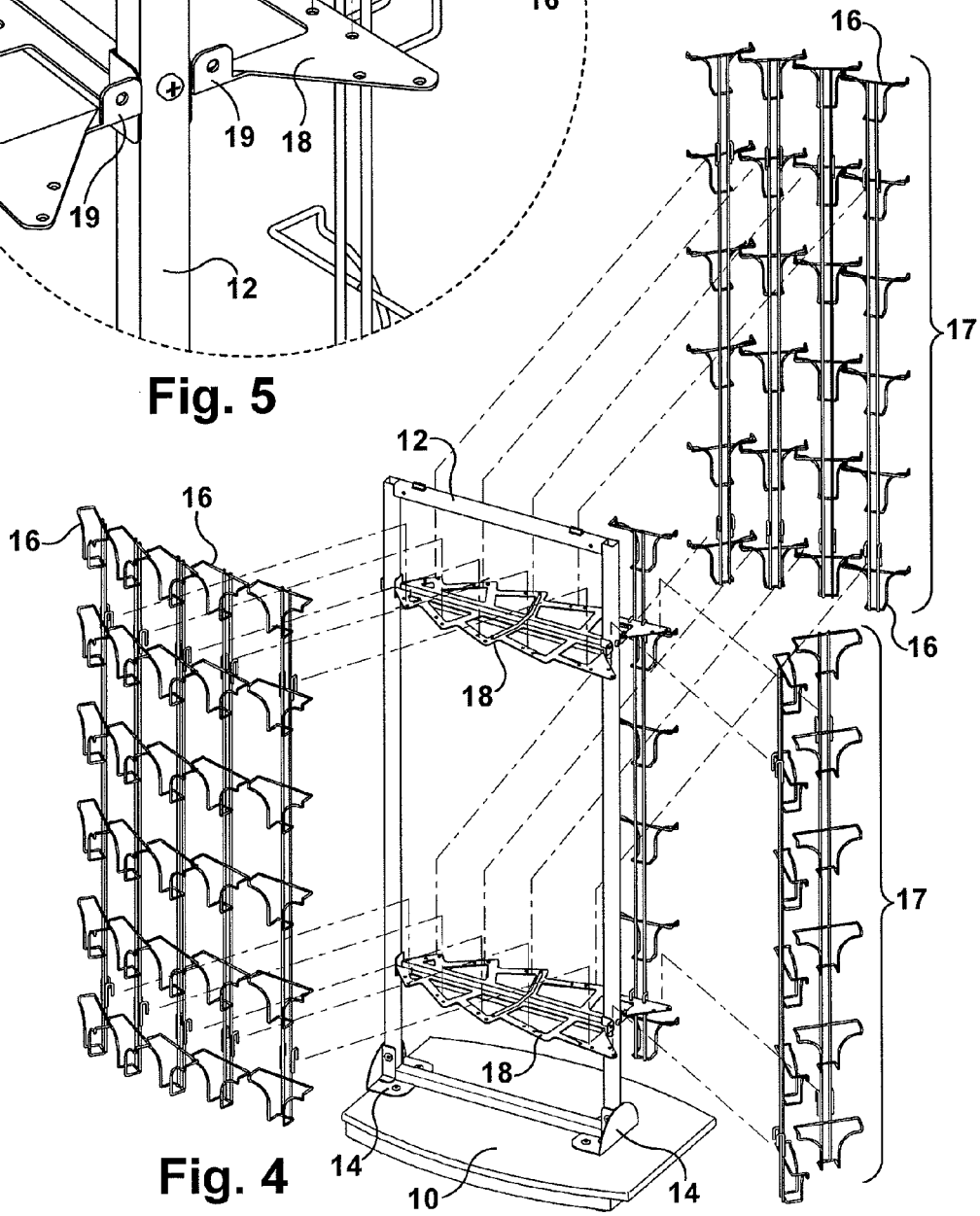
FIG. 4 is an exploded view of the Greeting Card Outpost of FIG. 1.

The outpost frame 12, shown in FIG. 4, is a substantially rectangular tube frame assembly having four (preferably 1-inch by 1-inch) square metal tube segments including upper and lower horizontal segments and right and left side vertical segments arranged in a rectangular fashion. The four segments of the outpost frame 12 may be manufactured with pre-positioned mounting holes to accommodate hardware connectors used to connect other fixture components to the outpost frame 12. The outpost frame 12 is connected along its bottom horizontal segment to an outpost base 10 using one or more base brackets 14. The outpost base 10 may be of any shape or size having a substantially planar upper surface to which the outpost frame 12 is attached. In a preferred embodiment, as shown in FIGS. 1 through 4, the base is generally rectangular with rounded edges. Castors may optionally be added to the display base 10 for ease of movement. As shown, the outpost frame 12 is attached to the outpost base 10 via two base brackets 14. Each base bracket 14 contains two spaced apart horizontal planar segments with a vertical channel therebetween. The base brackets 14 contain various pre-positioned mounting holes to facilitate attachment of the outpost frame 12 to the outpost base 10 (by attaching the base brackets 14 to the outpost base 10 and attaching the outpost frame 12 to the base brackets 14). A plurality of joint connector nut and bolt pairs may be used for attachment purposes. The two base brackets 14 are spaced apart on the outpost base 10 for approximately the width of the outpost frame 12 between the right and left vertical segments. One of the base brackets 14 is attached along an edge of the outpost base 10 and the other opposing base bracket 14 is spaced apart therefrom. The outpost frame 12, specifically the bottom horizontal segment, is placed into the opposing channels of the two base brackets 14 and secured thereto.

Figure 5:
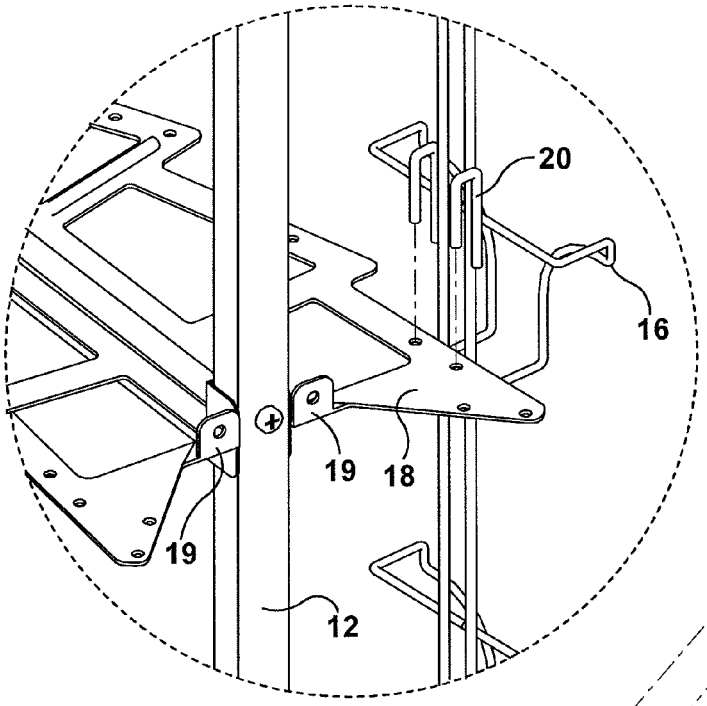
FIG. 5 is a close-up view of an attachment point of the greeting card pocket support and the outpost frame.

Once the outpost frame 12 is securely connected to the outpost base 10, one or more greeting card pocket supports 18 are attached to the outpost frame 12 between the right and left vertical segments. Each greeting card pocket support 18, shown in FIG. 4, has a first end and a second end opposite the first end. A u-shaped channel bisects the greeting card pocket support 18 with two fins located at opposing sides of the u-shaped channel. The two fins are mirror-images of each other and contain several step segments which project outward and are angled away from the u-shaped channel. Beginning at the first end of the greeting card pocket support 18, each pair of step segments extends away from the u-shaped channel for a distance which increases slightly with each adjacent pair of step segments moving along the u-shaped channel. At a certain point along the u-shaped channel, the distance of each pair of steps begin to decrease and slightly angle back towards the u-shaped channel before reaching the second end of the greeting card pocket support 18. The last pair of steps, located at the second end of the greeting card pocket support 18 extends past the u-shaped channel. Each pair of step segments located on the opposing set of fins contains, in a preferred embodiment, at least two pre-positioned, spaced apart mounting holes. These mounting holes accommodate attachment means for attaching the greeting card pocket assemblies 17 to the greeting card pocket support 18. The greeting card pocket support 18 also contains two upturned tabs 19 near the second end of the greeting card pocket support 18 and at the end of the u-shaped channel (shown in FIG. 5) which facilitate the attachment of graphic panels to the outpost fixture 100. In a preferred embodiment, a first greeting card pocket support 18 is attached to the outpost frame 12 between the right and left vertical segments proximate to the upper or top horizontal segment and a second greeting card pocket support 18 is attached to the outpost frame 12 between the right and left vertical segments proximate to the lower or bottom horizontal segment. Attachment of the greeting card pocket supports 18 to the outpost frame 12 is shown in FIG. 5. The placement of the two greeting card pocket supports 18 provides secure and stable attachment of the plurality of greeting card pocket assemblies 17 to the outpost fixture.

Figure 2:
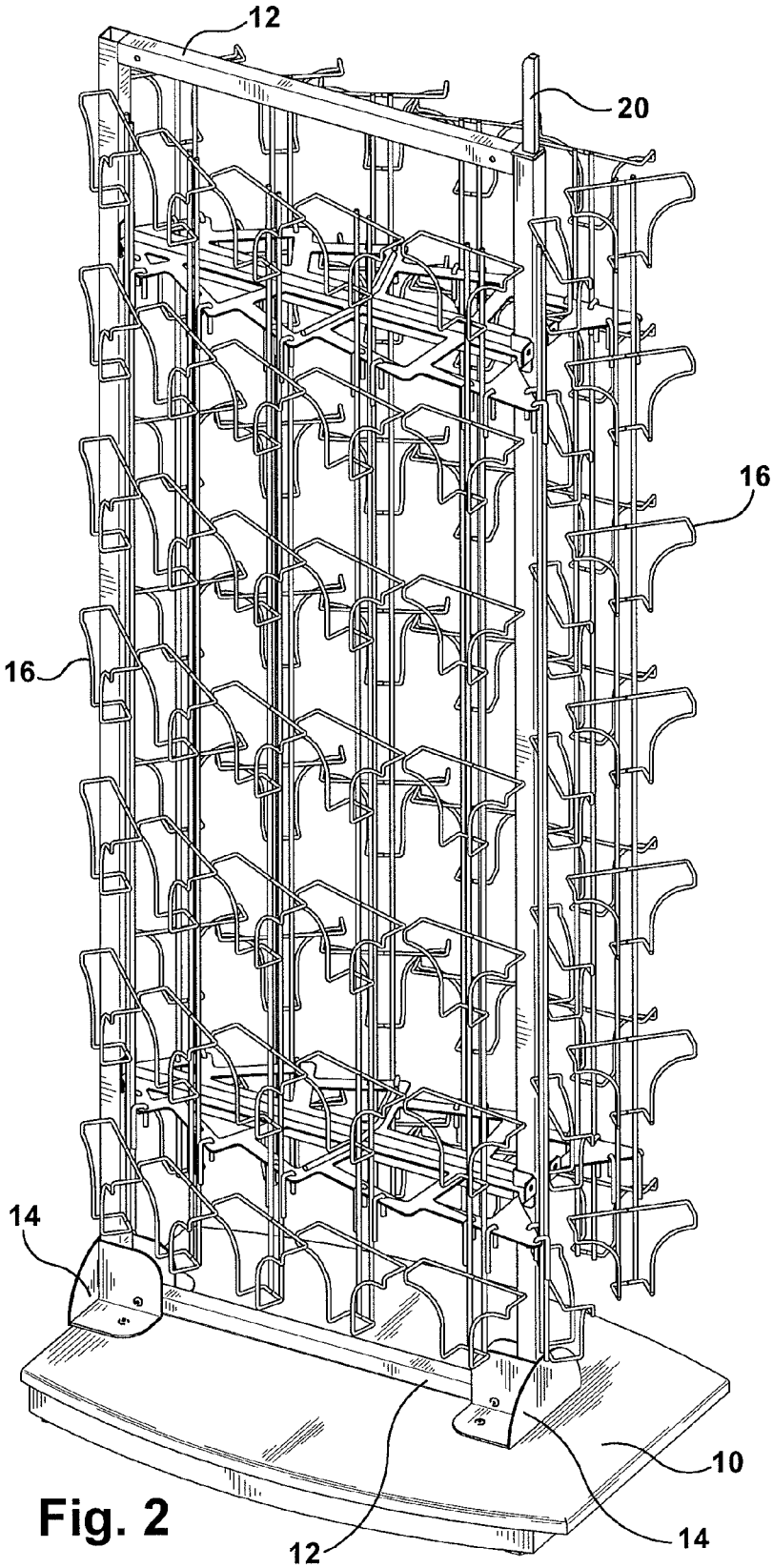
FIG. 2 is a perspective view of the Greeting Card Outpost of the present invention, without signage.
Figure 3:
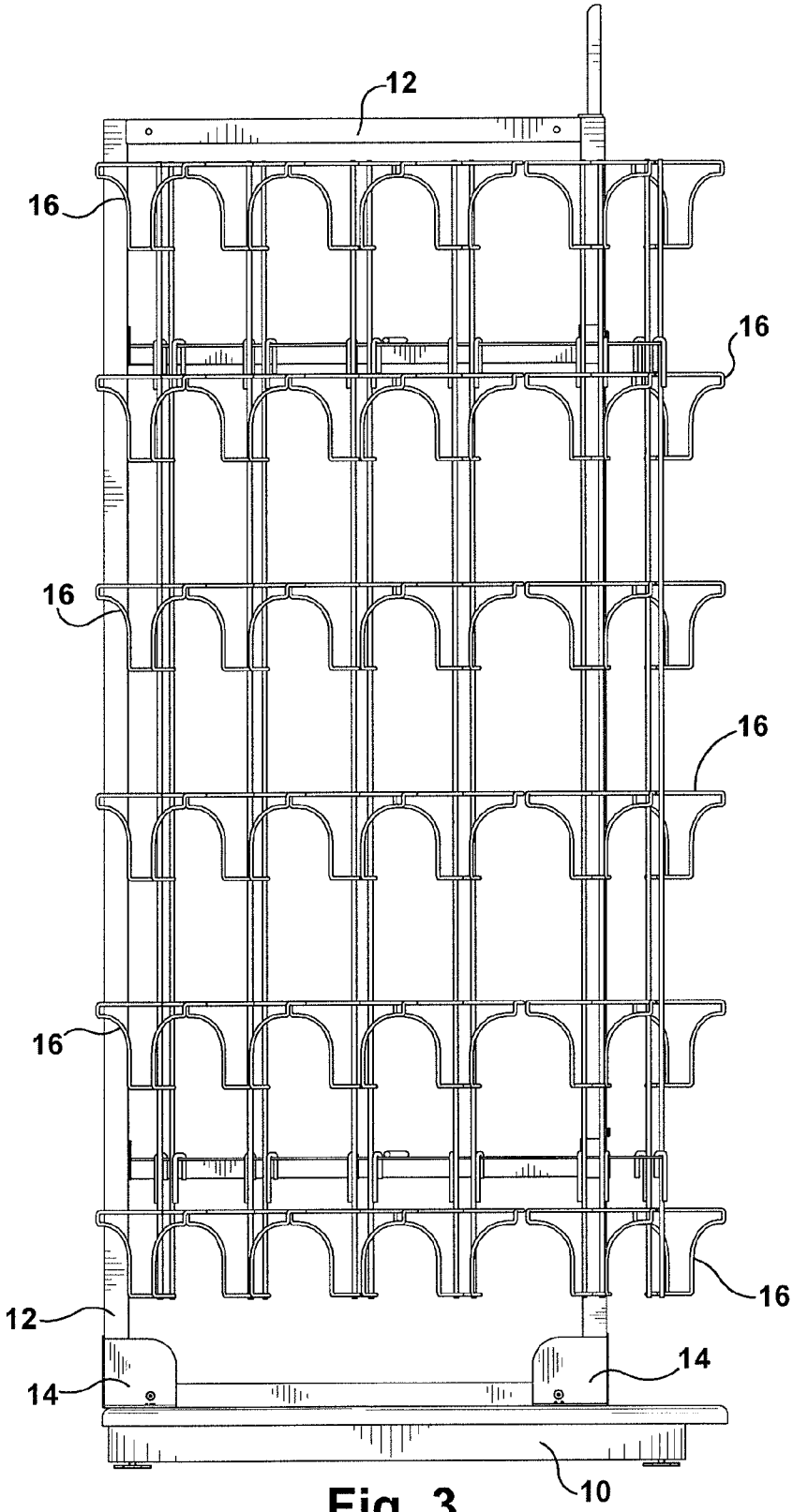
FIG. 3 is a side view of the Greeting Card Outpost of FIG. 1.

A plurality of greeting card pocket assemblies 17 are attached to the greeting card pocket supports 18 via the pre-positioned holes on the greeting card pocket supports 18, as shown in FIG. 4. Each greeting card pocket assembly 17 includes a plurality of wire-formed pockets 16 arranged in a spaced apart, vertical manner and attached to a vertical wire support or spine which runs the length of the greeting card pocket assembly 17. The vertical wire support or spine consists of two parallel, spaced apart vertical wires. The vertically arranged wire formed greeting card pockets, which are attached to the vertical wire support or spine, contain a horizontal back portion which serves as the back of the greeting card pocket 16, two side portions perpendicular to and extending outward from the horizontal back portion, which serve as the two sides of the greeting card pocket 16 and a center portion which is attached between the two sides. The center portion contains horizontal u-shaped wire which opens away from the vertical wire support or spine and serves as the bottom or floor of the greeting card pocket 16, and two arched portions which extends upward from the horizontal u-shaped wire in opposing directions and connect with the side portions to create a front face of the greeting card pocket 16. In a preferred embodiment, six greeting card pockets 16 are attached to a single vertical wire support or spine with a first card pocket 16 located at the top of the vertical wire support or spine and a sixth card pocket 16 located at the bottom of the vertical wire support or spine. A first pair of attachment prongs 20 is attached to the vertical wire support or spine and located in an upper region of the greeting card pocket assembly 17 (proximate to the second greeting card pocket 16) and a second pair of attachment prongs 20 is attached to the vertical wire support or spine and located in a lower region of the greeting card pocket assembly 17 (proximate to the fifth greeting card pocket 16). Each pair of attachment prongs 20 is two spaced apart, wire formed, downward extending channels, which are attached to the vertical wire support or spine. One side of each channel is inserted into a pre-positioned hole on the greeting card pocket support 18 for attachment of the greeting card pocket assembly 17 to the greeting card pocket support 18. Due to the unique shape and stepped arrangement of the greeting card pocket supports 18, the greeting card pockets 16 located on the greeting card pocket assemblies 17 are each positioned at an angle with respect to the outpost frame 12. Some of the greeting card pocket assemblies 17 partially overlap adjacent greeting card pocket assemblies 17, particularly the pocket assemblies 17 near to the first end of the outpost display 100. The amount of partial overlap between adjacent pairs of greeting card pocket assemblies 17 decreases as you move from a first end of the display 100 to a second end of the display 100. One or more greeting card pocket assemblies 17 do not overlap adjacent greeting card pocket assemblies 17 at all. In a preferred embodiment, approximately five (5) greeting card pocket assemblies 17 are attached to each side of the outpost frame 12 and two (2) greeting card pocket assemblies 17 are attached in a v-shaped or fin-like arrangement at one end of the display 100, as shown in FIGS. 1 and 2. The two (2) greeting card pocket assemblies 17 located at the end of the display in the v-shaped or fin-like arrangement, face each other and face away from the other greeting card pocket assemblies 17 located on the same side of the display 100. Since the greeting card pocket supports 18 extend beyond the boundaries of the outpost frame, shown in FIG. 5, these two (2) greeting card pocket assemblies are actually located on the outside of the outpost frame proximate to one of the right or left vertical segments in the v-shaped space created between the two opposing sides of the greeting card pocket supports at one end of the display 100. In total, approximately seventy-two (72) card pockets may be available to fill with sets of greeting cards in the preferred embodiment.

Various graphics panels or signage may also be attached to the outpost fixture 100. For example, graphic panels or signs 22 may be attached to the top edge of the outpost frame 12 along the upper horizontal segment. A top corner of the outpost frame 12 may contain a square hole or opening for insertion of a sign post or bayonette 20. Graphic panels 22 can be inserted into the sign post or bayonette 20 for display along the top edge of the outpost frame 12. The graphic panels may also extend down a side of the outpost frame 12 (opposite the sign post or bayonette 20), as shown in FIG. 1. Also, the two upturned tabs 19 on the second end of the greeting card pocket support 18 and at the end of the u-shaped channel (shown in FIG. 5) facilitate the attachment of graphic panels to one end of the outpost fixture 100.

Although the present invention has been described with referenced to a preferred embodiment having a certain number of components such as card pocket supports, card pocket assemblies, and individual card pockets, different variations of the preferred embodiment having more or less of the outpost components have been contemplated and are considered to be within the scope of the invention. Also, particular shapes have been described for the card pockets and other components, however, changes to the shape of particular components while maintaining the outwardly angled arrangement of greeting card pockets on opposing sides of a display frame have also been contemplated and are also considered to be a part of the invention. It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card outpost comprising:

a base;

a display frame attached to an upper surface of the base;

at least one greeting card pocket support structure attached to the display frame;

a plurality of greeting card pocket assemblies having a plurality of greeting card pockets attached thereto in a vertical manner, the plurality of greeting card pocket assemblies being attached to the at least one greeting card pocket support structure;

wherein each of the plurality of greeting card pocket assemblies are located at a different angle with respect to the display frame than the other greeting card pocket assemblies.

2. The greeting card outpost of claim 1, wherein the plurality of greeting card pocket assemblies are attached to opposing sides of the display frame.

3. The greeting card outpost of claim 1, wherein some of the plurality of greeting card pocket assemblies partially overlap an adjacent greeting card pocket assembly.

4. The greeting card outpost of claim 1, wherein two greeting card pocket assemblies are located in a v-shaped arrangement with respect to one another at one end of the outpost.

5. The greeting card outpost of claim 1, wherein at least four greeting card pocket assemblies are attached to each side of the greeting card pocket support structure.

6. A greeting card outpost comprising:

a rectangular display frame having a top horizontal segment opposite a bottom horizontal segment, a right vertical segment extending between the top and bottom horizontal segments, and a left vertical segment opposite the right vertical segment and a left vertical segment opposite the right vertical segment and extending between the top and bottom horizontal segments;

at least one greeting card pocket support having a bisecting center channel which is attached at one end to the right vertical segment of the rectangular display frame and at the opposite end to the left vertical segment of the rectangular display frame, a right side which is opposite of and a mirror image of a left side, the right and left sides having adjacent stepped segments extending outward from the center channel at an angle;

a plurality of greeting card pocket assemblies, each greeting card pocket assembly having a plurality of greeting card pockets attached and arranged in a vertical column, at least one greeting card pocket assembly attached to each stepped segment of the at least one greeting card pocket support wherein two greeting card pocket supports are arranged in a V-shape at one end of the display frame.

7. The greeting card outpost of claim 6, wherein some of the plurality of greeting card pocket assemblies partially overlap an adjacent greeting card pocket assembly.

8. The greeting card outpost of claim 6, wherein the greeting card pocket assembly located at one end of the at least one greeting card pocket support are closer together than the greeting card pocket assembly located at an opposite end of the at least one greeting card pocket support.

9. The greeting card outpost of claim 6, wherein each of the plurality of greeting card pockets is located at an angle with respect to the display frame.

10. The greeting card outpost of claim 6, wherein the plurality of greeting card pocket supports is arranged in a V-shape.

11. The greeting card outpost of claim 6, wherein there is one greeting card pocket support attached to an upper region of the display frame and one greeting card pocket support attached to a lower portion of the display frame.

12. The greeting card outpost of claim 6, wherein the rectangular display frame is attached to a base structure.

13. A greeting card outpost comprising:

a rectangular display frame having two opposing vertical segments and two opposing horizontal segments;

a generally horizontal V-shaped greeting card pocket support attached to the rectangular display frame between the two opposing vertical segments;

a plurality of greeting card columns having a plurality of greeting card pockets attached thereto in a vertical arrangement, the plurality of greeting card columns attached to opposing sides of the generally horizontal V-shaped greeting card pocket support thereby creating a generally V-shaped arrangement of greeting card pocket columns;

two greeting card pocket columns arranged in a V-shaped configuration and attached to one end of the display frame, partially between the V-shaped arrangement of greeting card pocket columns;

wherein at least some of the greeting card pocket columns overlap an adjacent greeting card pocket columns.

14. The greeting card outpost of claim 13, wherein the plurality of greeting card columns are all arranged at an angle with respect to the display frame.

15. The greeting card of claim 13, wherein each of the plurality of greeting card columns are located at a different angle with respect to the display frame than every other greeting card column.

16. The greeting card outpost of claim 13, wherein each of the plurality of greeting card columns contains at least 5 greeting card pockets.

17. The greeting card outpost of claim 13, wherein one generally horizontal V-shaped greeting card pocket support is attached to an upper region of the rectangular display frame and another generally horizontal greeting card pocket support is attached to a lower region of the rectangular display frame.

* * * * *